US006917135B1

(12) United States Patent
Yu

(10) Patent No.: US 6,917,135 B1
(45) Date of Patent: Jul. 12, 2005

(54) INSULATING MEMBER FOR CARBON BRUSH HOLDER

(75) Inventor: Meng-Chiu Yu, Taichung (TW)

(73) Assignee: Su-Chen Liao, Taichung (TW)

( * ) Notice: Subject to any disclaimer, the term of this patent is extended or adjusted under 35 U.S.C. 154(b) by 0 days.

(21) Appl. No.: 10/822,646

(22) Filed: Apr. 13, 2004

(51) Int. Cl.[7] ..... H01R 39/38
(52) U.S. Cl. ..... 310/239; 310/245
(58) Field of Search ..... 310/239, 245

(56) References Cited

U.S. PATENT DOCUMENTS 2,695,968 A * 11/1954 Welch et al. ..... 310/246
3,376,444 A * 4/1968 Eaton, Jr. et al. ..... 310/249
3,387,156 A * 6/1968 Elow et al. ..... 310/247
4,375,040 A * 2/1983 Sauerwein ..... 310/239
5,463,264 A * 10/1995 Koenitzer ..... 310/242
5,621,262 A * 4/1997 Han ..... 310/239
6,731,042 B1 * 5/2004 Bank et al. ..... 310/239

* cited by examiner

*Primary Examiner*—Joseph Waks
(74) *Attorney, Agent, or Firm*—Bacon & Thomas PLLC

(57) ABSTRACT

An insulating member for a carbon brush holder includes a main body and a cover member. The main body includes a through hole, which has an internal thread formed around its periphery. The internal thread is provided with a spiral internal thread tooth serially formed thereon. The internal thread tooth has a first internal tooth bevel and a second internal tooth bevel. The first internal tooth bevel has a larger distance between a peak and a bottom of the internal thread tooth than that of the second internal tooth bevel. The second internal tooth bevel has a first convexity abutting the first internal tooth bevel. The cover member has an external thread formed around a periphery thereof for threadedly fitted into the internal thread of the main body. Accordingly, the cover member can be tightly threadedly fitted with the main body.

20 Claims, 3 Drawing Sheets

INSULATING MEMBER FOR CARBON BRUSH HOLDER

BACKGROUND OF THE INVENTION

1. Field of the Invention

The present invention relates generally to internal components of motors, and more particularly to an insulating member for a carbon brush holder used in a motor.

2. Description of the Related Art

A conventional insulating member 60 for a carbon brush holder, as shown in FIG. 5, is comprised of a main body 61 and a cover member 62. The main body 61 has a first end 63 and a second end 64 respectively at two ends thereof, and a through hole 65 running through the first and second ends 63 and 64. The through hole 65 is provided with a first section 66 abutting the first end 63 for holding a copper member (not shown) of the carbon brush, and a second section 67 abutting the second end 64. The second section 67 of the through hole 65 is provided with an internal thread 70 having a spiral thread tooth 71, which has two bevels 72 that have the same distance between a peak and a bottom of the thread tooth 71. The cover member 62 is provided with an external thread 73 corresponding to the internal thread 70 of the main body 61 around a periphery thereof to be threadedly fitted into the second section 67 of the through hole 65 for stopping an end of a spring potentially mounted in the insulating member 60.

However, the conventional insulating member 60 has drawbacks as recited below. Both of the internal thread 70 of the main body 61 and the external thread 73 of the cover member 62 are conventional mechanical threads, such that looseness is generated between them during the process of screwing, and then tightness is generated between them while they are fully threadedly fitted with each other. Hence, when the insulating member 60 is applied inside the motor, the cover member 62 and the main body 61 easily get rid of tightness therebetween subject to the vibration of the motor to further cause the cover member 62 to slip off the main body 61, and additionally, the operator is uneasily aware of such condition during the operation, potential danger and harm against the user will be occurred.

SUMMARY OF THE INVENTION

The primary objective of the present invention is to provide an insulating member for a carbon brush holder; the insulating member includes a main body and a cover member, which are tightly interconnected.

The foregoing objective of the present invention is attained by the insulating member, which includes a main body and a cover member. The main body is made of thermosetting material, having a first end and a second end at two ends thereof and a through hole running through the first and second ends. The through hole is provide with a first section abutting the first end for receiving a copper member, and a second section abutting the first section and the second end and having an internal thread formed around its periphery. The cover member has an external thread formed around a periphery thereof for fitting the internal thread of the main body, such that the cover member can be threadedly fitted into the second section the main body. The internal thread is provided with a spiral internal thread tooth serially formed thereon. The internal thread tooth has a first internal tooth bevel facing the first end of the main body and a second internal tooth bevel facing the second end of the main body. The first internal tooth bevel has a larger distance between a peak and a bottom of the internal thread tooth than that of the second internal tooth bevel. The second internal tooth bevel has a first convexity abutting the first internal tooth bevel.

DETAILED DESCRIPTION OF PREFERRED EMBODIMENTS

Figure 1:
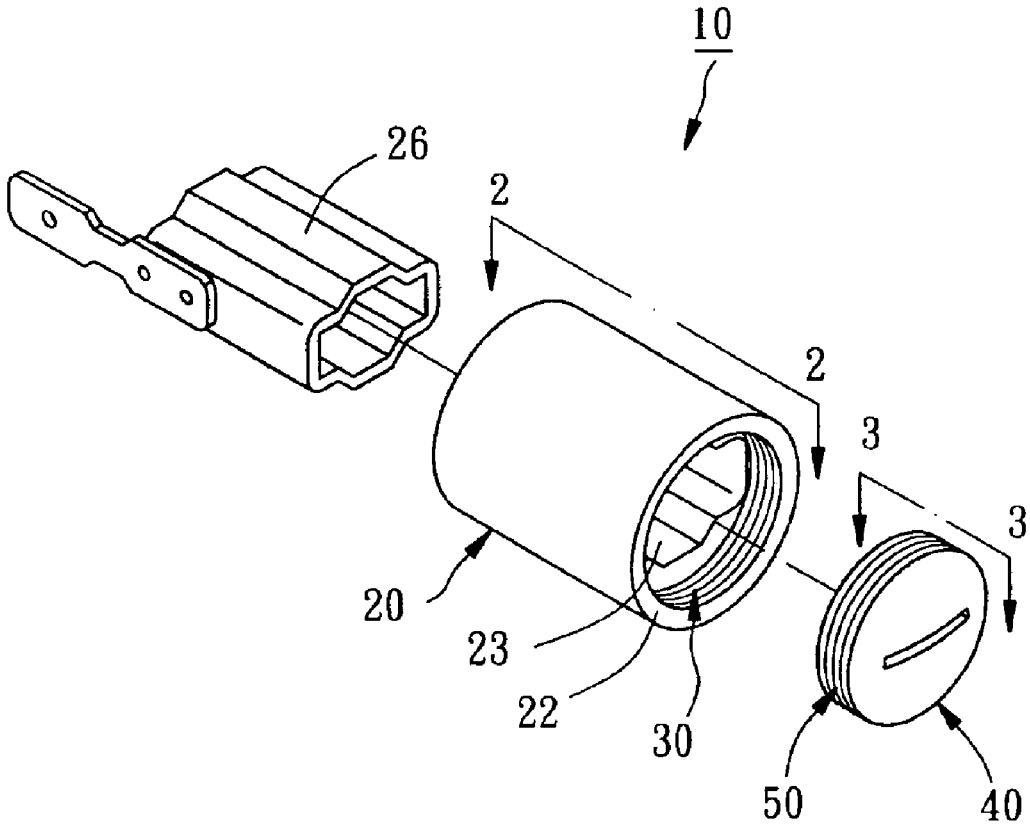
FIG. 1 is an exploded view of a preferred embodiment of the present invention.

As shown in FIG. 1 an insulating member 10 constructed according to a preferred embodiment of the present invention for a carbon brush holder includes a main body 20 and a cover member 40.

Figure 2:
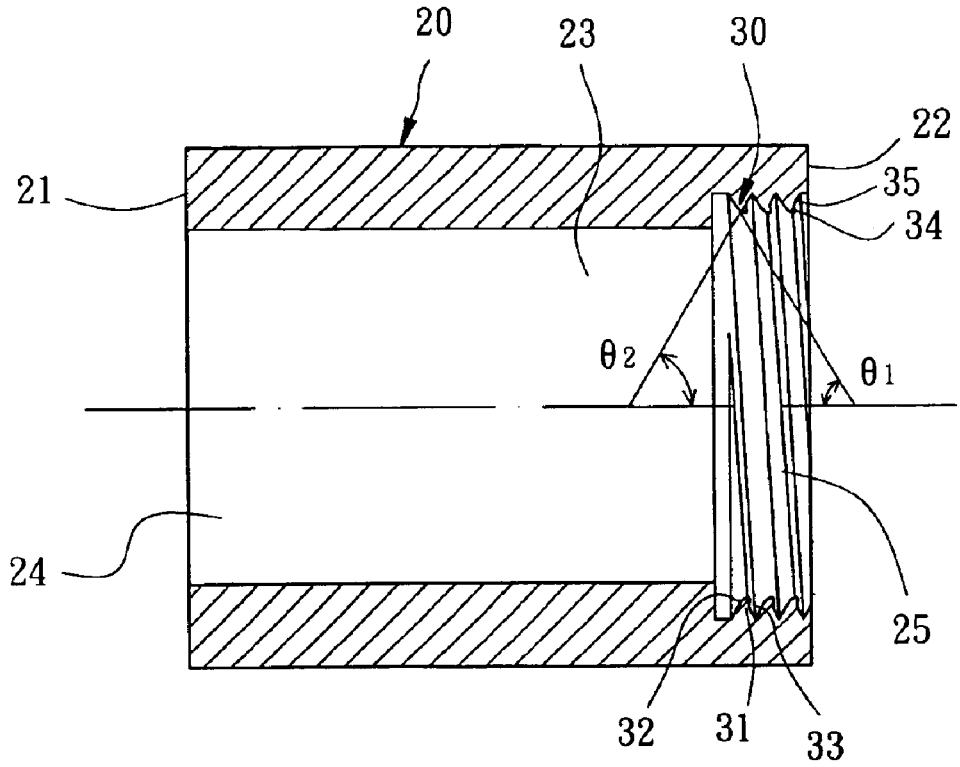
FIG. 2 is a longitudinal sectional view taken along a line 2—2 indicated in FIG. 1.

As shown in FIG. 2, the main body 20 is made of thermosetting material, having a first end 21 and a second end 22 at two ends thereof and a through hole 23 running through the first and second ends 21 and 22. The through hole 23 is provided with a first section 24 abutting the first end 21 for receiving a copper member 26, and a second section 25 positioned behind the first section 24 and abutting the second end 22 and having an internal thread 30 formed around its periphery. The internal thread 30 is formed of a spiral internal thread tooth 31, which has a first internal tooth bevel 32 facing the first end 21 and a second internal tooth bevel 33 facing the second end 22 of the main body 20. An imaginary extended plane of the first internal tooth bevel 32 intersects with an imaginary long axle running through a center of the main body 20 for a first (gamma) angle $\theta_1$. An imaginary extended plane of the second internal tooth bevel 33 intersects with the imaginary long axle of the main body 20 for a second (delta) angle $\theta_2$. The first angle $\theta_1$ is smaller than the second angle $\theta_2$. The first internal tooth bevel 32 has a larger distance between a peak and a bottom of the internal thread tooth 31 than that of the second internal tooth bevel 33. The second internal tooth bevel 33 has a first convexity 34 approaching the first internal tooth bevel 32, and a first concavity 35 recessed therefrom towards the first internal tooth bevel 32 and approaching the bottom of the internal thread tooth 31.

Figure 3:
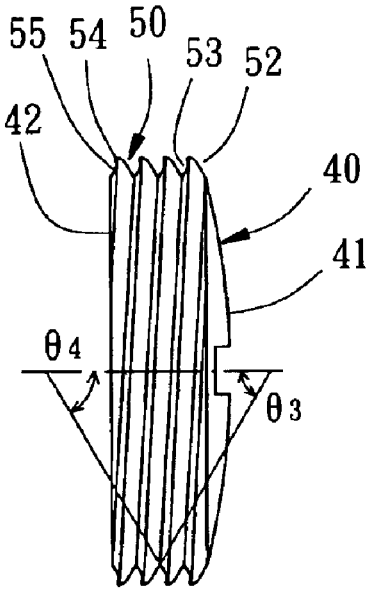
FIG. 3 is a longitudinal sectional view taken along a line 3—3 indicated in FIG. 1.

Referring to FIG. 3, the cover member 40 includes a top side 41, a bottom side 42, and an external thread 50 formed around an external periphery thereof for threadedly fitted with the internal thread 30 of the main body 20 to enable the cover member 40 to be threadedly connected with the main body 20. The external thread 50 is formed of a spiral external thread tooth 51, having a first external tooth bevel 52 facing the top side 41 and a second,external tooth bevel 53 facing the bottom side 42. An imaginary extended plane of the first external tooth bevel 52 intersects with an imaginary long axle running through a center of the cover member 40 for a third (alpha) angle $\theta_3$. An imaginary extended plane of the second external tooth bevel 53 intersects with the imaginary long axle of the cover member 40 for a fourth (delta) angle $\theta_4$. The third angle $\theta_3$ is smaller than the four angle $\theta_4$. The first external tooth bevel 52 has a larger distance between a peak, and a bottom of the external thread tooth 51 than that of the second external tooth bevel 53. The second external tooth bevel 53 has a second convexity 54 approaching the first external tooth bevel 52, and a second concavity 55 recessed therefrom towards the first external tooth bevel 52 and approaching the bottom of the external thread tooth 51.

Figure 4:
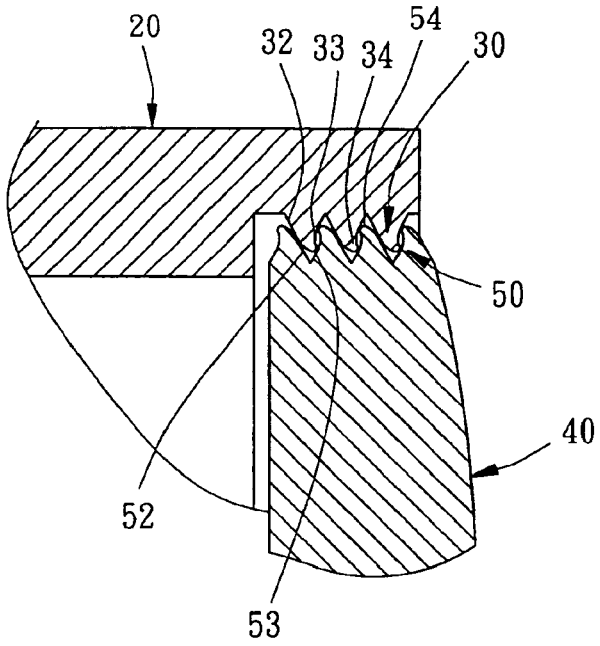
FIG. 4 is a partial sectional view of the preferred embodiment of the present invention, showing that an internal thread of a main body is threadedly fitted with an external thread of a cover member.
Figure 5:
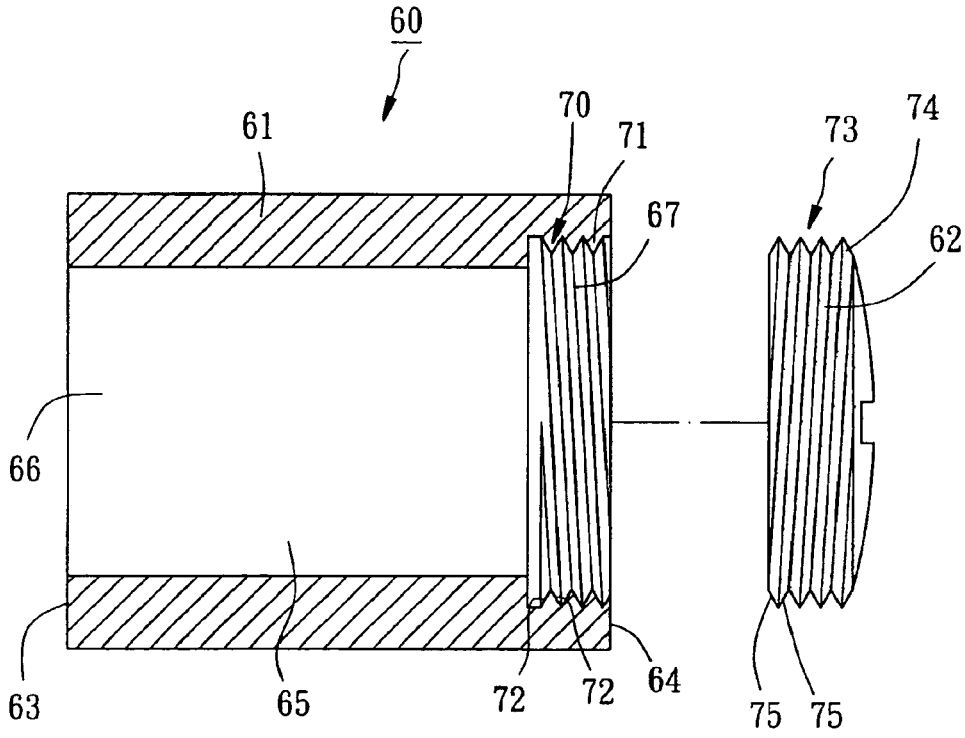
FIG. 5 PRIOR ART
FIG. 5 is a sectional view of the prior art.

Referring to FIG. 4, when the cover member 40 is threadedly mounted into the main body 20, the first internal tooth bevel 32 contacts against the first external tooth bevel 52, the second internal tooth bevel 33 contacts against the second external bevel 53, the convexity 34 slightly interferes with the second external tooth bevel 53, and the second convexity 54 slightly interferes with the second internal tooth bevel 33, such that the cover member 40 and the main body 20 are tightly threadedly fitted with each other.

From the above recitation, the co-interference between the internal thread 30 of the main body 20 and the external thread 50 of the cover member 40 causes that the main body 20 and the cover member 40 can be preferably tightly threadedly interconnected, thereby improving the drawback of the aforementioned prior art.

What is claimed is:

1. An insulating member for a carbon brush holder, said insulating member comprising:

a main body made of thermosetting material, said main body having a first end and a second end at two ends thereof and a through hole running said first and second ends, said through hole having a first section abutting said first end for receiving a copper member, and a second section abutting said first section and said second end, said second section having an internal thread formed around its periphery, said internal thread having a spiral internal thread tooth, said internal thread tooth having a first internal tooth bevel facing said first end and a second internal tooth bevel facing said second end, said first internal tooth bevel having a larger distance between a peak and a bottom of said internal thread tooth than that of said second internal tooth bevel, said second internal tooth bevel having a first convexity abutting said first internal tooth bevel; and a cover member having an external thread formed around its external periphery for fitting said internal thread of said main body to enable said cover member to be threadedly mounted into said second section of said main body.

2. The insulating member as defined in claim 1, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second external tooth bevel, said second external tooth bevel having a second convexity abutting said first external tooth bevel.

3. The insulating member as defined in claim 1, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second convexity abutting said first external tooth bevel.

4. The insulating member as defined in claim 1, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second; external tooth bevel, said second external tooth bevel having a second concavity recessed therefrom towards said first external tooth bevel.

5. The insulating member as defined in claim 1, wherein said cover member comprises a top side and a bottom side, said cover member being threadedly connected with said main body by said bottom side facing said second end of said main body, said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second concavity recessed therefrom towards said first external tooth bevel.

6. An insulating member for a carbon brush holder, said insulating member comprising:

a main body made of thermosetting material, said main body having a first end and a second end at two ends thereof and a through hole running said first and second ends, said through hole having a first section abutting said first end for receiving a copper member, and a second section abutting said first section and said second end, said second section having an internal thread formed around its periphery, said internal thread having a spiral internal thread tooth, said internal thread tooth having a first internal tooth bevel facing said first end and a second internal tooth bevel facing said second end, an imaginary extended plane of said first internal tooth bevel intersecting with an imaginary long axle running through a center of said main body for a gamma angle, an imaginary extended plane of said second internal tooth bevel intersecting with the imaginary long axle of said cover member for a delta angle, said gamma angle being smaller than said delta angle, said second internal tooth bevel having a first convexity abutting said first internal tooth bevel; and a cover member having an external thread formed around its external periphery for fitting said internal thread of said main body to enable said cover member to be threadedly mounted into said second section of said main body.

7. The insulating member as defined in claim 6, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second external tooth bevel, said second external tooth bevel having a second convexity abutting said first external tooth bevel.

8. The insulating member as defined in claim 6, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second convexity abutting said first external tooth bevel.

9. The insulating member as defined in claim 6, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second external tooth bevel, said second external tooth bevel having a second concavity recessed therefrom towards said first external tooth bevel.

10. The insulating member as defined in claim 6, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second concavity recessed therefrom towards said first external tooth bevel.

11. An insulating member for a carbon brush holder, said insulating member comprising:

a main body made of thermosetting material, said main body having a first end and a second end at two ends thereof and a through hole running said first and second ends, said through hole having a first section abutting said first end for receiving a copper member, and a second section abutting said first section and said second end, said second section having an internal thread formed around its periphery, said internal thread having a spiral internal thread tooth, said internal thread tooth having a first internal tooth bevel facing said first end and a second internal tooth bevel facing said second end, said first internal tooth bevel having a larger distance between a peak and a bottom of said internal thread tooth than that of said second internal tooth bevel, said second internal tooth bevel having a first concavity recessed therefrom towards said first internal tooth bevel; and a cover member having an external thread formed around its external periphery for fitting said internal thread of said main body to enable said cover member to be threadedly mounted into said second section of said main body.

12. The insulating member as defined in claim 11, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second external tooth bevel, said second external tooth bevel having a second convexity abutting said first external tooth bevel.

13. The insulating member as defined in claim 11, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second convexity abutting said first external tooth bevel.

14. The insulating member as defined in claim 11, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second external tooth bevel, said second external tooth bevel having a second concavity recessed therefrom towards said first external tooth bevel.

15. The insulating member as defined in claim 11, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second concavity recessed therefrom towards said first external tooth bevel.

16. An insulating member for a carbon brush holder, said insulating member comprising:

a main body made of thermosetting material, said main body having a first end and a second end at two ends thereof and a through hole running said first and second ends, said through hole having a first section abutting said first end for receiving a copper member, and a second section abutting said first section and said second end, said second section having an internal thread formed around its periphery, said internal thread having a spiral internal thread tooth, said internal thread tooth having a first internal tooth bevel facing said first end and a second internal tooth bevel facing said second end, an imaginary extended plane of said first internal tooth bevel intersecting with an imaginary long axle running through a center of said main body for a gamma angle, an imaginary extended plane of said second internal tooth bevel intersecting with the imaginary long axle of said cover member for a delta angle, said gamma angle being smaller than said delta angle, said second internal tooth bevel having a first concavity recessed therefrom towards said first internal tooth bevel; and a cover member having an external thread formed around its external periphery for fitting said internal thread of said main body to enable said cover member to be threadedly mounted into said second section of said main body.

17. The insulating member as defined in claim 16, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second external tooth bevel, said second external tooth bevel having a second convexity abutting said first external tooth bevel.

18. The insulating member as defined in claim 16, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second convexity abutting said first external tooth bevel.

19. The insulating member as defined in claim 16, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, said first external tooth bevel having a larger distance between a peak and a bottom of said external thread tooth than that of said second external tooth bevel, said second external tooth bevel having a second concavity recessed therefrom towards said first external tooth bevel.

20. The insulating member as defined in claim 16, wherein said cover member comprises a top side and a bottom side, said cover member being threadedly connected with said main body by said bottom side facing said second end of said main body; said external thread of said cover member is formed of a spiral external thread tooth having a first external tooth bevel facing said top side of said cover member, and a second external tooth bevel facing said bottom side of said cover member, an imaginary extended plane of said first external tooth bevel intersecting with an imaginary long axle running through a center of said cover member for an alpha angle, an imaginary extended plane of said second external tooth bevel intersecting with the imaginary long axle of said cover member for a beta angle, said alpha angle being smaller than said beta angle, said second external tooth bevel having a second concavity recessed therefrom towards said first external tooth bevel.

* * * * *